US006506527B1

(12) United States Patent
Demejo et al.

(10) Patent No.: US 6,506,527 B1
(45) Date of Patent: Jan. 14, 2003

(54) STAIN-RESISTANT POLYESTER OVERCOAT FOR A PHOTOGRAPHIC ELEMENT

(75) Inventors: Lawrence P. Demejo, Rochester, NY (US); Charles E. Romano, Jr., Rochester, NY (US); Sandra D. Nesbitt, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/845,563

(22) Filed: Apr. 30, 2001

(51) Int. Cl.[7] ..... G03C 11/08; G03C 5/26

(52) U.S. Cl. ..... 430/14; 430/350; 430/533; 430/432; 430/961

(58) Field of Search ..... 430/14, 523, 961, 430/350, 432

(56) References Cited

U.S. PATENT DOCUMENTS 5,958,601 A 9/1999 Salsman ..... 428/480
6,087,051 A 7/2000 Shoji et al. ..... 430/14
6,274,298 B1 * 8/2001 Nair et al. ..... 430/961

* cited by examiner

*Primary Examiner*—Richard L. Schilling
(74) *Attorney, Agent, or Firm*—Christ P. Konkol

(57) ABSTRACT

The present invention relates to imaged photographic elements comprising an overcoat layer of a water-dispersible, hydrophobic polyester resin having the following general formula:

$$I_n—P—A_m$$

wherein I is an ionic group; n is an integer from 1–3; P is a polyester backbone; A is an Asiatic group comprising a straight or branched chain fatty acid or triglyceride thereof having from about 6 to about 24 carbon atoms; and m is an integer from 3–8. Such a protective overcoat provides excellent stain resistance for an imaged photographic element.

17 Claims, No Drawings

STAIN-RESISTANT POLYESTER OVERCOAT FOR A PHOTOGRAPHIC ELEMENT

FIELD OF THE INVENTION

The present invention relates to imaged photographic elements having a protective overcoat that resists fingerprints, common stains, and spills. More particularly, the present invention provides a protective overcoat comprising an improved polyester material that is applied to photographic elements following image development.

BACKGROUND OF THE INVENTION

Gelatin has been used extensively in a variety of photographic elements as the binder because of its many unique and advantageous properties. For example, its property of water swellability allows processing chemistry to be carried out to form silver halide-based photographic images. However, due to this same property, photographic elements with exposed gelatin-containing materials, no matter if they are formed on transparent or reflective media, have to be handled with extreme care so as not to be in contact with any solutions that may stain and damage the images. Accidental spillage of common household solutions such as coffee or punch can damage photographic elements such as photographic prints.

There have been attempts over the years to provide protective layers for gelatin-based photographic systems that will protect the images from damage from staining solutions. U.S. Pat. No. 2,173,480 describes a method of applying a colloidal suspension to moist film as the last step of photographic processing before drying. A number of patents describe methods of solvent coating a protective layer on the image after photographic processing is completed and are described, for example, in U.S. Pat. Nos. 2,259,009, 2,331,746, 2,798,004, 3,113,867, 3,190,197, 3,415,670 and 3,733,293. More recently, U.S. Pat. No. 5,376,434 describes a protective layer formed on a photographic print by coating and drying a latex on a gelatin-containing layer bearing an image. The latex is a resin having a glass transition temperature of from 30° C. to 70° C. Another type of protective coating involves the application of UV-polymerizable monomers and oligomers on a processed image followed by radiation exposure to form crosslinked protective layer, which is described in U.S. Pat. Nos. 4,092,173, 4,171,979, 4,333,998 and 4,426,431. A drawback for both the solvent coating method and for the radiation cure method is the health and environmental concern of those chemicals or radiation to the coating operator. Another drawback is that the photographic materials need to be coated after the processing step. Thus, the processing equipment needs to be modified and the personnel running the processing operation need to be trained to apply the protective coating.

U.S. Pat. No. 6,087,051 relates to an imaging element containing a protective overcoat layer of an aqueous polyurethane resin or an aqueous polyacryl resin. In addition, there are comparison examples in that patent which use a polyester resin, and the aqueous polyurethane resin and polyacryl resins are said to have advantages over the polyester resin. However, there are problems using a polyurethane resin or an aqueous polyacryl resin in that these resins have to be synthesized from virgin raw materials and the resins cannot be recycled. Preferably, the protective overcoat is composed of a water-dispersible polyurethane polycarbonate resin to provide water-resistance, scratch resistance, glossiness, image storage stability, and resistance to fingerprints. The expense of such materials, in addition to the difficulty of coating a print in a photoprocessing lab, has continued to hinder the commercialization of such technology. Another disadvantage of a polyurethane coating is that it is not environmentally friendly. Typical polyester materials such as unmodified polyethylene terephthalate (PET), on the other hand, are known to be environmentally friendly, but are do not provide good stain resistance in a protective overcoat.

U.S. Pat. No. 5,958,601 to Salsman discloses the use of water dispersible hydrophobic polyester resins derived typically from PET having improved hydrophobicity or non-polar characteristics. This resin can be used to coat substrates such as cellulosic or synthetic substrates such as paper. For example, printing paper coated with the resins of U.S. Pat. No. 5,958,601 are disclosed as having excellent water repellency and ink holdout as well as increased strength and gloss. Salsman does not coat a gelatin substrate, nor an imaged substrate. Applicants have found that traditional photographic elements using cross-linked gelatin as a binder already have a water resistance comparable to the polyester material of Salsman.

PROBLEM TO BE SOLVED BY THE INVENTION

There is a need for an imaged photographic element with improved durability, particularly with improved stain resistance. There is also a need for a photographic element containing an overcoat layer made with a material that can be made from recycled materials and is capable of being recycled.

SUMMARY OF THE INVENTION

The present invention provides an aqueous-coatable overcoat that can be coated onto an imaged photographic element to form a stain-resistant protective overcoat. More particularly, the present invention describes an uppermost-layer or overcoat composition that can be applied to the photographic element after image development. These and other objects are achieved in accordance with the present invention which comprises a photographic element comprising a support having one or more imaged layers, derived from a silver halide emulsion comprising a colored dye formed from the reaction product of an oxidized developer and a dye forming coupler, and overlying the imaged layers, an overcoat layer of a water-dispersible, hydrophobic polyester resin having the following general formula:

$$I_n—P—A_m \qquad \text{Formula (I)}$$

Wherein I is an ionic group; n is an integer from 1–3; P is a polyester backbone; A is an Asiatic group comprising a straight or branched chain fatty acid or triglyceride thereof having from about 6 to about 24 carbon atoms; and m is an integer from 3–8.

In another preferred embodiment of the invention, the water-dispersible, hydrophobic polyester as described above is physically mixed or blended with a thermoplastic or thermosetting polymer that is a polyurethane and copolymers thereof, acrylate or methacrylate esters and copolymers thereof. The thermoplastic or thermosetting polymer lends added hydrophobicity to the layer, as well as enhanced coating flexibility and serves as a diluent to the polyester component to minimize cross-linking which would deleteriously alter coating properties. In another preferred embodiment of the invention, the water-dispersible, hydrophobic polyester as described above is physically mixed or blended with a microgel. In the preferred embodiment, the Tg of the overcoat composition is at least 70° C.

Another aspect of the invention provides for a method of forming a stain-resistant coating image on an imaged photographic element.

DETAILED DESCRIPTION OF THE INVENTION

The present invention provides an improved overcoat formulation for the imaged side of a photographic element or material, including photographic prints, which encounter frequent handling and abuse by end users. The preferred overcoat formulation of this invention comprises 5% to 95% by weight, preferably 50% to 80% by weight, (based on the dry laydown of the total overcoat) of a polyester material as described herein and 5% to 95% by weight, preferably 20% to 50% by weight (based on the dry laydown of the total overcoat) of a hydrophobic thermoplastic or thermosetting polymer.

The polyester material of the invention are preferably water dispersible polyesters of Formula (I) above, wherein the ionic groups I in the above formula which provide the polymer with water-dispersibility are typically derived from a carboxylic acid group which is introduced into the resin by polyacid monomers such as trimellitic anhydride, trimellitic acid, or maleic anhydride or sulfonate groups which come from monomers such as dimethyl 5-sulfoisophthalate, dimethyl 5-sulfo,1,3-benzenedicarboxylate, sulfoisophthalate ethylene glycol, dihydroxyethyl-5-sulfo 13-benzenedicarboxylate, or from sulfonated alkenically unsaturated end groups as described in U.S. Pat. No. 5,281,630 and U.S. Pat. No. 6,087,051, the disclosures of which are hereby incorporated by reference. The weight percent of ionic monomers in the resin is from 1% to 20%, but 1% to 10% is preferred.

The backbone P of the polymer in the above formula is as polyester. It can be any linear or branched polyester made using polyacids and polyalcohols. The weight percent of the polyester backbone ingredients range from 30–80% of the whole resin, with the most preferred being 50–60% by weight. Examples of aromatic dicarboxylic acids useful in the backbone polyester polymer, P, employed in the invention include, but are not limited to, terephthalic, isophthalic, phthalic, and 2,6-naphthoic, succinic, glutaric, adipic, 1,4-cyclohexane dicarboxylic, maleic, fumaric, and azelaic. The polyalcohol component of the polyester can be virtually any dihydroxy functional compound. Aliphatic and alicyclic glycols would be the most useful. Useful glycols include, but are not limited to, ethylene glycol, 1,3-propylene glycol, 1,2-propylene glycol, dipropylene glycol, tripropylene glycol, 1,4-butanediol, 1,5-pentanediol, 1,6-hexanediol, cyclohexanedimethanol, diethylene glycol, and triethylene glycol.

The backbone polyester consisting of any combination of the above polyacids and glycols may further directly include or incorporate by transesterification a multifunctional polyol selected from, but not limited to, glycerol, trimethylopropane, erythritol, pentaerythritol, trimethylolethane, or a monosaccharide.

As noted above, A in the above formula is an Asiatic group comprising a straight or branched chain fatty acid or triglyceride thereof having from about 6 to about 24 carbon atoms, such as stearic, oleic, palmitic, lauric, linoleic, linolenic, behenic acid, or their mixtures. These can come from hydrogenated or unhydrogenated animal or vegetable oil, such as beef tallow, lard, corn oil, or soy bean oil. The weight percent of the Asiatic moiety can be 10–60%, with 20–40% by weight being the preferred amount.

In a preferred embodiment of the invention, the water-dispersible, hydrophobic polyester resin employed comprises a reaction product of 30–70% by weight of a poly (ethylene terephthalate) condensation polymer; 5–40% by weight of a hydroxy functional compound having at least two hydroxyl groups; 1–20% by weight of a carboxy functional compound having at least two carboxyl groups and 10–60% by weight of a $C_6$–$C_{24}$ straight chain or branched fatty acid or triglyceride. The resin is further characterized in that the hydroxy functional compound is present at 1–3 times the equivalents of the hydrophobic moiety. The preparation of such hydrophobic polyester resins is described in detail in U.S. Pat. No. 5,958,601, the disclosure of which is hereby incorporated by reference. In another preferred embodiment, the water-dispersible, hydrophobic polyester resin comprises water-dispersed transesterified polyester, e.g., poly(ethylene terephthalate) transesterified in the presence of stearic acid and trimellitic acid, or oleic acid and trimellitic acid.

The weight average molecular weight of the polyester according to the above formula is preferably 3000 to 50,000, preferably 4000 to 8000.

As mentioned above, in one embodiment of the invention, the water-dispersible, hydrophobic polyester as described above is physically mixed with a thermoplastic or thermosetting polymer to form a blend (not separate particles) with the polyester in the overcoat. The thermoplastic or thermosetting polymer lends added hydrophobicity to the layer, as well as enhanced coating flexibility and serves as a diluent to the polyester component to minimize cross-linking which would deleteriously alter coating properties. A hydrophobic thermoplastic or thermosetting polymer, in addition to the polyester polymer, can provide water resistance in addition to stain resistance.

Examples of such thermoplastic or thermosetting polymers useful in the invention include, but are not limited to, carboxylated styrene butadiene, styrene/ acrylate or methacrylate ester compositions containing acrylic or methacrylic acids, hydrolyzed styrene maleic anhydride copolymers, styrene maleic acid salt copolymers, styrene maleic ester copolymers, styrene (meth)acrylate copolymers, styrene (meth)acrylate ester copolymers, styrene acrylate ester acrylonitrile terpolymers, acrylonitrile (meth)acrylate salt copolymers, polycarbonate-based polyurethanes, polyester-based polyurethanes, cellulose polymers, such as methyl cellulose and cellulose acetate butyrate, polyesters, polyamides, polyacetals, epoxy polymers, phenoxy polymers, etc. Preferred polymers are polyurethanes, acrylate or methacrylate ester polymers, and copolymers thereof. In a preferred embodiment, the water-dispersible, hydrophobic polyester resin and thermoplastic or thermosetting polymer is present in a ratio from about, 1:6 to 6:1, preferably 1:4 to 4:1.

In the preferred embodiment, the Tg of the overcoat composition comprising the polyester and the thermoplastic or thermosetting polymer is at least 70° C., more preferably at least 90° C., most preferably at least 100° C., wherein the Tg of the polyester in the composition is less than 70° C.

Examples of formulations of polyesters according to the present invention are available under the tradename EvCote® (for example, PGLR-25®, PWRH-25®, PGLRF-40®, PWRHF-40®, PWRHS-37®, PSX-25®, and the like) commercially available from EvCo Research Incorporated, Atlanta, Ga., USA In another preferred embodiment, the overcoat layer may also contain an effective amount of particles of a microgel, such as a microgel of methyl methacrylate/ethylene glycol dimethacrylate/acrylic acid, effectively increasing the Tg of the overcoat, which helps prevent blocking. These are disclosed in commonly assigned U.S. Pat. No. 6,130,014, hereby incorporated by reference in its entirety. Microgel particles are highly crosslinked polymer particles prepared by the emulsion polymerization. The definition of microgel particles can be found in British Polymer Journal 21, 107–115(1989) by W. Funke and in Angew. Chem. 100, 1813–1817 (1988) by M. Antonietti. Microgel particles are highly crosslinked and thus not soluble in any solvents but are dispersible in water. The preferred microgel particles of this invention have Tg greater than 70° C., average particle size between 20 nm and 80 nm and preferably 30 nm to 70 nm and are highly water-swellable. The microgels of this invention can broadly be described as crosslinked particles of a copolymer containing as its essential monomeric components a small amount of a difunctional crosslinking monomer, a polymerizable carboxylic acid monomer and one or more polymerizable low water-solubility vinyl monomers. Microgel particles of this invention typically comprise from about 5 to 50%, and most preferably from about 5 to 20% by total weight of the monomer mixture of the polymerizable carboxylic acid monomer, 2 to 20% of difunctional crosslinking monomer, with the balance of the microgel composition comprising water-insoluble, vinyl or addition-type monomers.

Examples of the polymerizable carboxylic acid monomer are methacrylic acid, acrylic acid, crotonic acid, itaconic acid, maleic acid, fumaric acid, various other substituted carboxylic acid monomers containing from 3 to 8 carbon atoms such as 2-carboxyethylacrylate, 3-acryloamido-3-methyl-butanoic acid, 3-acryloamidohydroxy-acetic acid, acryloamidohexanoic acid, N,N-bisacryloamido-acetic acid, and the monoesters of dicarboxylic acids such as methyl hydrogen maleate, ethyl hydrogen fumarate, and the like, of which methacrylic acid is particularly preferred.

Another monomeric component of the microgel particles is the relatively water-insoluble, carboxylic-free vinyl monomer. Suitable monomers of this class include styrene, the o-,m-,and p-alkyl or aryl styrenes wherein the substituent group has from 1 to 8 carbon atom such as o-methylstyrene, methylstyrene, p-methylstyrene, p-tert-butylstyrene, the 2,4-, 2,5- and 3,4-dimethylstyrenes, 4-methoxystyrene, 4-phenylstyrene, 4-phenoxystyrene, 4-benzylstyrene, 2,6-dimethylstyrene, 2,6-dimethoxystyrene, 2,5-diethylstyrene, alpha-methylstyrene, 3,4-dimethylstyrene, halostyrenes such as 4-chlorostyrene, the 2,5-, 3,4- and 2,6-dichlorostyrene, and the corresponding fluorostyrenes and bromstyrenes; vinyl toluene, isopropenyl toluene, and vinylnaphthalene; alkyl or aryl esters of the ethylenically unsaturated carboxylic acids having from 1 to about 8 carbon atoms in the ester (alcohol) group, such as the methyl, ethyl, propyl, butyl, hexyl, ethylhexyl, phenyl, and benzyl methacrylates, acrylates, and crotonates; dimethyl maleate; dibutylmaleate; dibutylfumarate; dihexylitaconate; nitrile monomers, such as acrylonitrile and methacrylonitrile; vinyl esters such as vinyl acetate, vinyl propionate, vinyl stearate, vinyl butyrate, vinyl laurate, etc.; and mixtures thereof. Preferred monomers are styrene and its derivatives and methacrylate monomers such as methyl methacrylate and ethyl methacrylate, such that the resulting microgel particle has a Tg equal to or greater than 60° C. Two or more preferred monomers can also be polymerized together in accordance with any of the various solubility and polymerizability requirements discussed above.

The difunctional crosslinking monomer is employed in an amount sufficient to crosslink the aqueous emulsion copolymer, thereby converting the copolymer to a non-linear polymeric microgel, without appreciably reducing the water-swellability. Typical amounts of the difunctional monomer are from 1 to 20% and more preferably from 2 to 10 % of the total polymer composition. Illustrative of difunctional crosslinking agents which may be used in the present invention are compounds such as ethylene glycol dimethacrylate, methylene bisacrylamide, methylene bismethacrylamide, divinyl benzene, vinyl methacrylate, vinyl crotonate, vinyl acrylate, divinyl acetylene, trivinyl benzene, glycerine trimethylacrylate, pentaerythritol tetramethacrylate, triallyl cyanurate, divinyl ethane, divinyl sulfide, divinyl sulfone, hexatriene, triethyleneglycol dimethacrylate, diallyl cyanamide, glycol diacrylate, ethylene glycol divinyl ether, diallyl phthalate, divinyl dimethyl silane and glycerol trivinyl ether, of which divinyl benzene and ethylene glycol dimethacrylate are particularly preferred.

In another preferred embodiment, the overcoat layer may contain microgel particles in combination with a an effective amount of a synthetic or of a synthetic or natural wax, such as an aqueous dispersion of high density polyethylene, Jon Wax 26 ® (S. C. Johnson Co.) or an aqueous dispersion of carnauba wax (Michelman Co.), to lower the kinetic coefficient of friction or surface energy of the overcoat, as measured between the overcoat and a Carbide ball sled below 0.6.

Such waxes are disclosed in commonly assigned U.S. Pat. No. 5,965,304, hereby incorporated by reference in its entirety.

The protection layer described above may be coated by conventional coating means onto the support such as wound wire rod coating, slot coating, slide hopper coating, gravure, curtain coating and the like. U.S. Pat. No. 6,087,051 to Shoji et al., hereby incorporated by reference in its entirety, discloses methods of coating a printed image with a protective overcoat, which methods can be used to apply the materials of the present invention.

There may be added to the overcoat composition a dye that will impart color or tint or dyes that impart speed control. A UV absorber may be added to make the overcoat UV absorptive, thus protecting the image from UV induced fading. Other compounds may be added to the coating composition, depending on the functions of the particular layer, including surfactants, hardeners or crosslinking agents for the gelatin, emulsifiers, coating aids, lubricants, matte particles, rheology modifiers, antifoggants, inorganic fillers such as conductive and nonconductive metal oxide particles, pigments, magnetic particles, biocides, and the like. The coating composition may optionally also include a small amount of organic solvent, preferably the concentration of organic solvent is less than 5 percent by weight of the total coating composition.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol™ OT), and alkylcarboxylate salts such as sodium decanoate.

The surface characteristics of the overcoat are in large part dependent upon the physical characteristics of the polyester. However, the surface characteristics of the overcoat also can be modified by the conditions under which the surface is optionally fused. For example, in contact fusing, the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Matte particles well known in the art may optionally be used in the coating composition of the invention, such matting agents have been described in *Research Disclosure* No. 308119, published December 1989, pages 1008 to 1009. However, the amount of matting agents should be limited so as not to interfere with fusing, if optionally used. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfmic acid, active methylene, amino, amide, allyl, and the like.

In order to reduce the sliding friction of the photographic elements in accordance with this invention, the coating composition may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004, 927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Polyethylene particles are also useful to provide lubrication. For example, U.S. Pat. No.5,965,304 describes polyethylene lubricants in protective overcoats. Other lubricants useful in the present invention are described in further detail in Research Disclosure No.308119, published December 1989, page 1006.

The coating composition of the invention is advantageously applied simultaneously with the underlying layers of the photographic element for ease of manufacture. However, it is also possible to apply the overcoat separately by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published December 1989, pages 1007 to 1008.

The laydown of the overcoat will depend on its field of application. For a photographic element, the laydown is preferably 5 to 100 g/m$^2$, more preferably 10 to 30 g/m$^2$.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, x-ray films, graphic arts films, paper prints or microfiche.

Photographic elements can be either simple black-and-white or monochrome elements or multilayer and/or multicolor elements adapted for use in a negative-positive process or a reversal process. Generally, the photographic element is prepared by coating one or both sides of the a support with one or more layers comprising a dispersion of silver halide crystals in an aqueous solution of gelatin and optionally one or more subbing layers. The coating process for the various layers can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December, 1978).

Multicolor elements typically contain dye image-forming units sensitive to each of the three primary regions of the spectrum. The imaged elements can be imaged elements which are viewed by transmission, such a negative film images and reversal film images or they can be imaged elements that are viewed by reflection, such as paper prints. Because of the amount of handling that can occur with photographic prints, they are the preferred photographic elements according to the present invention.

The photographic elements in which the images to be protected are formed can have the structures and components shown in Research Disclosure 37038 and 38957. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The element can contain additional layers, such as filter layers, interlayers, overcoat layers, subbing layers, and the like. All of these can be coated on a support which can be transparent (for example, a film support) or reflective (for example, a paper support). Support bases that can be used include both transparent bases, such as those prepared from polyethylene terephthalate, polyethylene naphthalate, cellulosics, such as cellulose acetate, cellulose diacetate, cellulose triacetate, and reflective bases such as paper, coated papers, melt-extrusion-coated paper, and laminated papers, such as those described in U.S. Pat. Nos. 5,853,965; 5,866,282; 5,874,205; 5,888,643; 5,888,681; 5,888,683; and 5,888,714. Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. Nos. 4,279,945 and U.S. Pat. No. 4,302,523.

Suitable silver halide emulsions and their preparation, as well as methods of chemical and spectral sensitization, are described in Sections I through V of Research Disclosure 37038 (or 38957). Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process*, 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element or color paper element, the element is first treated with a black and white developer (that is, a developer which does not form colored dyes with the coupler compounds) followed by a treatment to render developable unexposed silver halide (usually chemical or light fogging), followed by treatment with a color developer. Development may be followed by bleach-fixing, to remove silver or silver halide, washing and drying.

The present invention can also be used to provide an overcoat layer in accordance with this invention that is particularly advantageous for use with photographic prints due to superior physical properties including excellent stain resistance, while providing exceptional transparency and toughness necessary for providing resistance to scratches, abrasion, blocking, and ferrotyping.

The present invention is illustrated by the following Examples.

EXAMPLES

C-1(Comparative Polymer)

Comparative overcoat composition C1 was a non-modified polyester composed of isophthalic acid, diethylene glycol and a sulfo-derivative of dicarboxylic acid, Eastman Chemical Co. WD- SIZE ® (U.S. Pat. No. 6,087,051, col. 21), at 11 $\mu$m.

OC-1 of the Invention

Overcoat OC-1 consisted of a blend of EvCo Research Inc. PGLR-25®, transesterified PET and a microgel of methyl methacrylate/ethylene glycol dimethacrylate/acrylic acid (80:10:10 wt. ratio), an aqueous dispersion of high density polyethylene, JON WAX 26 ® (S. C. Johnson Co.) and an aqueous dispersion of carnauba wax (Michelman Co.), (73.4:23:1.8:1.8 wt. ratio).

OC-2 of the Invention

This overcoat OC-2 consisted of EvCo Research Inc. PGLR-25®, transesterified PET.

OC-3 of the Invention

This overcoat OC-3 consisted of a blend of EvCoResearch Inc. PWRH-25®, PET transesterified in the presence of stearic acid and trimellitic acid and a polyurethane based on a polycarbonate polyol, bishydroxymethylol propionic acid, bisphenol-A and isophorone-diisocyanate (Eastman Kodak Co.) (1:1 wt. ratio).

OC-4 of the Invention

This overcoat OC-4 consisted of a blend of EvCo Research Inc. PWRH-25®, PET transesterified in the presence of stearic acid and trimellitic acid and a microgel of methyl methacrylate/ethylene glycol dimethacrylate/acrylic acid (80:10:10 wt. ratio), an aqueous dispersion of high density polyethylene, JON WAX 26 ® (S. C. Johnson Co.) and an aqueous dispersion of carnauba wax (Michelman Co.),. (73.4:23:1.8:1.8 wt. ratio).

OC-5 of the Invention

This overcoat OC-5 consisted of EvCo Research Inc. PWRH-25®, Poly(ethylene terephthalate), (PET) transesterified in the presence of stearic acid and trimellitic acid.

OC-6 of the Invention

This overcoat OC-6 consisted of a blend of EvCo Research Inc. PGLR-25®, transesterified PET and a polyurethane based on a polycarbonate polyol, bishydroxymethylol propionic acid, bisphenol-A and isophorone-diisocyanate (Eastman Kodak Co.), 25:75 wt ratio.

OC-7 of the Invention

This overcoat OC-7 consisted of a blend of EvCo Research Inc. PGLR-25®, transesterified PET and a polyurethane based on a polycarbonate polyol, bishydroxymethylol propionic acid, bisphenol-A and isophorone-diisocyanate (Eastman Kodak Co.), 50:50 wt. ratio.

JON WAX® 26 is a high density polyethylene in the aqueous dispersion form, purchased from SC Johnson. The number average molecular weight of polyethylene is 7100. The average particle size of dispersion is 50 nm and Tm is 130° C. The aqueous dispersion was dialyzed against distilled water for 16 hours using membrane with molecular weight cutoff of 20,000 to remove excess surfactants and salts.

Photographic Sample Preparation

A conventional colored photographic element EASTMAN KODAK EDGE 8® paper was prepared as follows:

Blue Sensitive Emulsion (Blue EM-1). A high chloride silver halide emulsion is precipitated by adding approximately equimolar silver nitrate and sodium chloride solutions into a well stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contains cubic shaped grains having edge length of 0.6 $\mu$m. The emulsion is optimally sensitized by the addition of a colloidal suspension of aurous sulfide and heat ramped to 60° C. during which time blue sensitizing dye BSD-4, potassium hexchloroiridate, Lippmann bromide and 1-(3-acetamidophenyl)-5-mercaptotetrazole were added.

Green Sensitive Emulsion (Green EM-1): A high chloride silver halide emulsion is precipitated by adding approximately equimolar silver nitrate and sodium chloride solutions into a well stirred reactor containing, gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic shaped grains of 0.3$\mu$m in edge-length size. The emulsion is optimally sensitized by the addition of glutaryldiaminophenyldisulfide, a colloidal suspension of aurous sulfide and heat ramped to 55° C. during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1): A high chloride silver halide emulsion is precipitated by adding approximately equimolar silver nitrate and sodium chloride solutions into a well stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 micrometers in edgelength size. The emulsion is optimally sensitized by the addition of glutaryldiaminophenyldisulfide, sodium thiosulfate, tripotassium bis {2-[3-(2-sulfobenzamido)phenyl]-mercaptotetrazole} gold(I) and heat ramped to 64° C. during which time 1-(3-acetamidophenyl)-5-mercaptotetrazole, potassium hexachloroiridate, and potassium bromide are added. The emulsion is then cooled to 40° C., pH adjusted to 6.0 and red sensitizing dye RSD-1 is added.

Coupler dispersions were emulsified by methods well known in the art. The following photographic layers were coated in sequence on polyethylene-laminated photographic paper.

| Layer | Item | Laydown (mg/ft$^2$) |
|---|---|---|
| Layer 1 | Blue Sensitive Layer | |
| | Gelatin | 122.0 |
| | Blue sensitive silver (Blue EM-1) | 22.29 |
| | Y-4 | 38.49 |
| | ST-23 | 44.98 |
| | Tributyl Citrate | 20.24 |
| | ST-24 | 11.25 |
| | ST-16 | 0.883 |
| | Sodium Phenylmercaptotetrazole | 0.009 |
| | Piperidino hexose reductone | 0.2229 |
| | 5-chloro-2-methyl-4-isothiazolin-3-one/2-methyl-4-isothiazolin-3-one(3/1) | 0.019 |
| | SF-1 | 3.40 |
| | Potassium chloride | 1.895 |
| | Dye-1 | 1.375 |
| Layer 2 | Interlayer | |
| | Gelatin | 69.97 |
| | ST-4 | 9.996 |
| | S-4 | 18.29 |
| | 5-chloro-2-methyl-4-isothiazolin-3-one/2-methyl-4-isothiazolin-3-one(3/1) | 0.009 |
| | Catechol disulfonate | 3.001 |
| | SF-1 | 0.753 |
| Layer 3 | Green Sensitive Layer | |
| | Gelatin | 110.96 |
| | Green sensitive silver (Green EM-1) | 9.392 |
| | M-4 | 19.29 |
| | Oleyl Alcohol | 20.20 |
| | S-4 | 10.40 |
| | ST-21 | 3.698 |

-continued

| Layer | Item | Laydown (mg/ft$^2$) |
|---|---|---|
| | ST-22 | 26.39 |
| | Dye-2 | 0.678 |
| | 5-chloro-2-methyl-4-isothiazolin-3-one/2-methyl-4-isothiazolin-3-one(3/1) | 0.009 |
| | SF-1 | 2.192 |
| | Potassium chloride | 1.895 |
| | Sodium Phenylmercaptotetrazole | 0.065 |
| Layer 4 | M/C Interlayer | |
| | Gelatin | 69.97 |
| | ST-4 | 9.996 |
| | S-4 | 18.29 |
| | Acrylamide/t-Butylacrylamide sulfonate copolymer | 5.026 |
| | Bis-vinylsulfonylmethane | 12.91 |
| | 3,5-Dinitrobenzoic acid | 0.009 |
| | Citric acid | 0.065 |
| | Catechol disulfonate | 3.001 |
| | 5-chloro-2-methyl-4-isothiazolin-3-one/2-methyl-4-isothiazolin-3-one(3/1) | 0.009 |
| Layer 5 | Red Sensitive Layer | |
| | Gelatin | 125.96 |
| | Red Sensitive silver (Red EM-1) | 17.49 |
| | IC-35 | 21.59 |
| | IC-36 | 2.397 |
| | UV-1 | 32.99 |
| | Dibutyl sebacate | 40.49 |
| | S-6 | 13.50 |
| | Dye-3 | 2.127 |
| | Potassium p-toluenethiosulfonate | 0.242 |
| | 5-chloro-2-methyl-4-isothiazolin-3-one/2-methyl-4-isothiazolin-3-one(3/1) | 0.009 |
| | Sodium Phenylmercaptotetrazole | 0.046 |
| | SF-1 | 4.868 |
| Layer 6 | UV Overcoat | |
| | Gelatin | 76.47 |
| | UV-2 | 3.298 |
| | UV-1 | 18.896 |
| | ST-4 | 6.085 |
| | SF-1 | 1.162 |
| | S-6 | 7.404 |
| | 5-chloro-2-methyl-4-isothiazolin-3-one/2-methyl-4-isothiazolin-3-one(3/1) | 0.009 |
| Layer 7 | SOC | |
| | Gelatin | 59.98 |
| | Ludox AM ™ (colloidal silica) | 14.99 |
| | Polydimethylsiloxane (DC200 ™ ) | 1.877 |
| | 5-chloro-2-metbyl-4-isothiazolin-3-one/2-methyl-4-isothiazolin-3-one(3/1) | 0.009 |
| | SF-2 | 0.297 |
| | Tergitol 15-S-5 ™ (surfactant) | 0.186 |
| | SF-1 | 0.753 |
| | Aerosol OT ™ (surfactant) | 0.269 |

IC-35

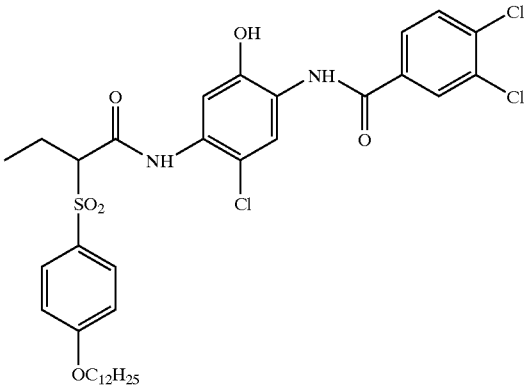

-continued
| Layer | Item | Laydown (mg/ft$^2$) |
|---|---|---|
| | 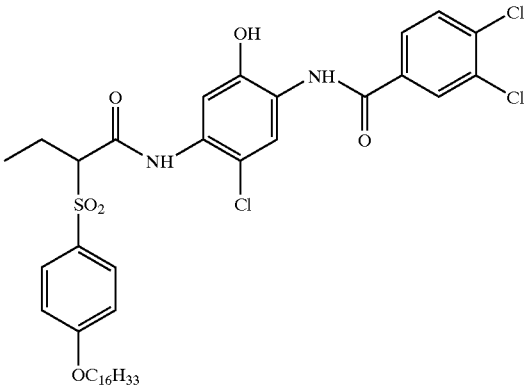 | IC-36 |
| | 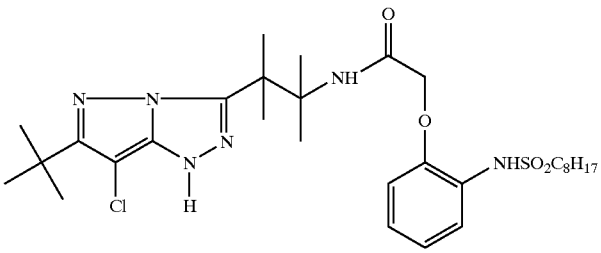 | M-4 |
| | 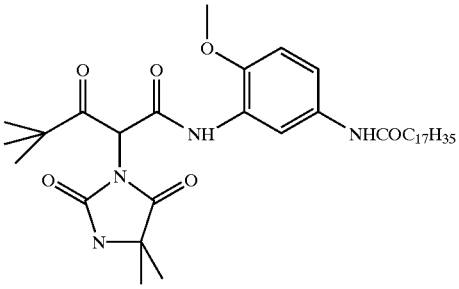 | Y-4 |
| | 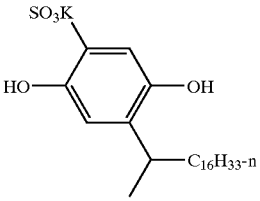 | ST-16 |
| | 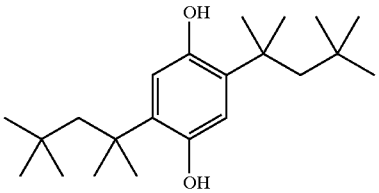 | ST-4 |
| | 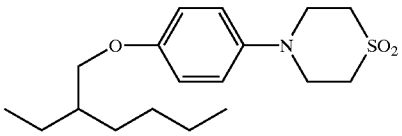 | ST-21 |

-continued
| Layer | Item | Laydown (mg/ft$^2$) |
|---|---|---|
| | 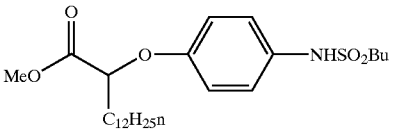 | ST-22 |
| | 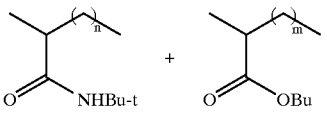 *n*:*m* = 1:1; MW = 75,000–100,000 | ST-23 |
| | 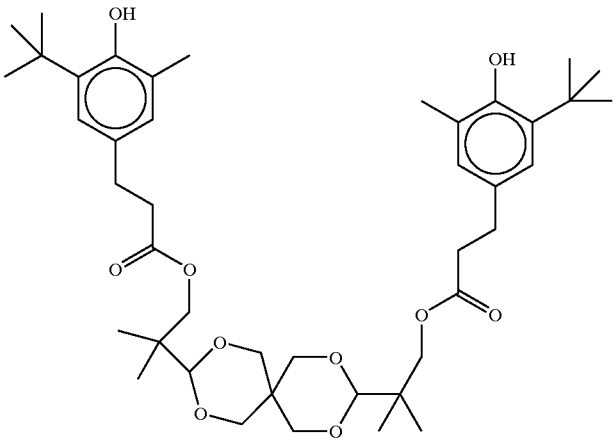 | ST-24 |
| | 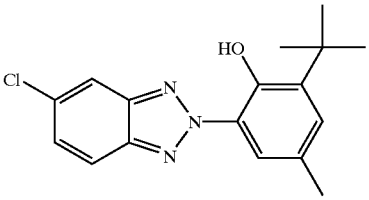 | UV-1 |
| | 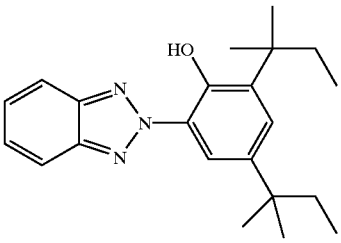 | UV-2 |
| | 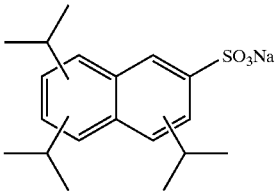 | SF-1 |
| | $CF_3.(CF_2)_7.SO_2Na$<br>S-4 = Diundecyl phthalate<br>S-6 = Tris(2-ethylhexyl)phosphate | SF-2 |

-continued
| Layer | Item | Laydown (mg/ft$^2$) |
|---|---|---|
| | 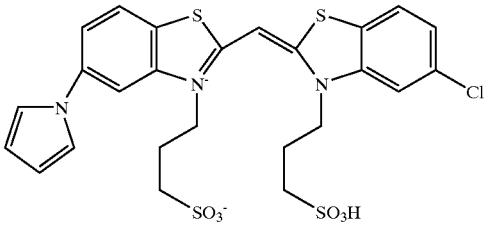 BSD-4 | |
| | 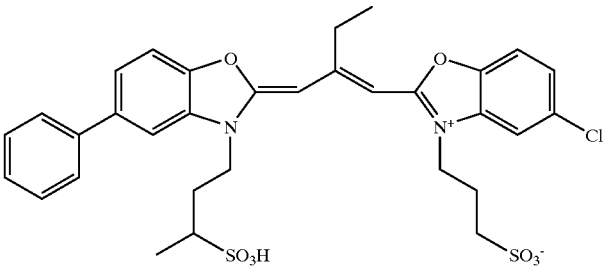 GSD-1 | |
| | 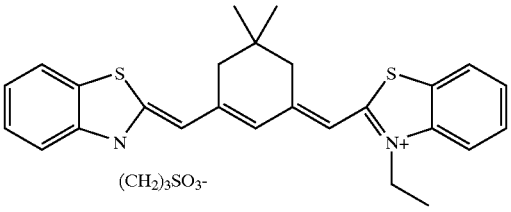 RSD-1 | |
| | 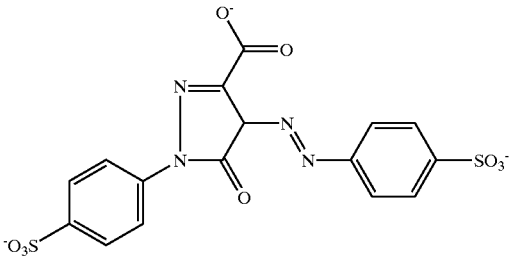 DYE-1 | |
| | 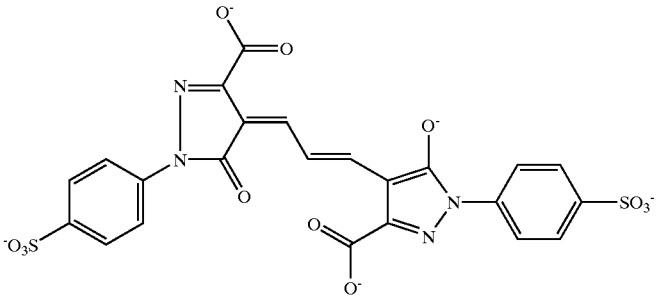 DYE-2 | |

-continued

| Layer | Item | Laydown (mg/ft$^2$) |
|---|---|---|
| | DYE-3 | |

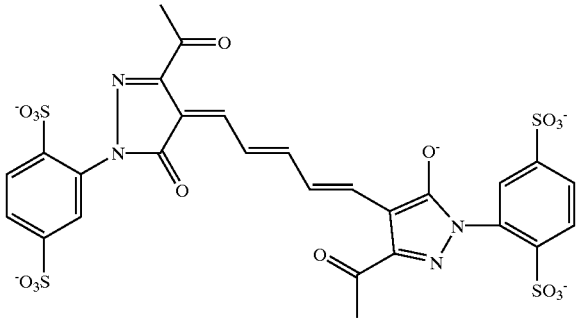

Stain Resistance Test

Drops of coffee, fruit punch and mustard were then placed on printed areas of the elements. The stain materials were allowed to penetrate for one hour and then blotted off using a lint-free cloth. A damp cloth was the used to gently wipe any stain remaining on the print. The sample was then evaluated by visually inspecting for staining, surface damage, dye loss, density loss, cracking or any other visible defect. The following ratings were used for the evaluation:

1=No change

2=Surface damage

3=Slight stain or color change

4=Significant stain or color change

Example 1

Image photographic paper were coated with various protective overcoats of the present invention, as indicated in Table 1 below. The photographic paper was overcoated using a computer-driven extrusion coating device. After coating, the imaged elements were placed in an oven at 60° C. for 5 minutes to ensure proper drying of the coating. The results are shown in Table 1 below.

TABLE 1

| Overcoat | Photo-graphic Paper | Microns/ dry | Coffee | Fruit Punch | Mustard | Average Stain |
|---|---|---|---|---|---|---|
| None | EDGE 8 | | 4 | 4 | 2 | 3.3 |
| C-1 | EDGE 8 | 2.5 | 3 | 1 | 3 | 2.3 |
| OC-1 | EDGE 8 | 2.5 | 2 | 1 | 2 | 1.7 |
| OC-2 | EDGE 8 | 2.5 | 1 | 1 | 2 | 1.3 |
| OC-3 | EDGE 8 | 2.5 | 1 | 1 | 2 | 1.3 |
| OC4- | EDGE 8 | 2.5 | 2 | 2 | 2 | 2.0 |
| OC-5 | EDGE 8 | 2.5 | 2 | 2 | 2 | 2.0 |
| None | FUJI* | | 4 | 4 | 2 | 3.3 |
| C-1 | FUJI | 2.5 | 3 | 1 | 2 | 2.0 |
| OC-3 | FUJI | 2.5 | 2 | 1 | 2 | 1.7 |
| OC-6 | FUJI | 2.5 | 1 | 1 | 2 | 1.3 |
| OC-7 | FUJI | 2.5 | 1 | 1 | 2 | 1.3 |
| OC-5 | FUJI | 2.5 | 2 | 1 | 1 | 1.3 |
| OC-1 | FUJI | 2.5 | 1 | 1 | 2 | 1.3 |
| OC-4 | FUJI | 2.5 | 1 | 1 | 1 | 1.0 |

*FUJI CRYSTAL ARCHIVE color paper from (Fuji Photo Co.)

The above results show that the elements of the invention having a protective overcoat had better overall stain resistance than the control elements or the comparative polyester overcoat.

The invention has been described in detail with particular reference to certain preferred embodiments thereof, but it will be understood that variations and modifications can be effected within the spirit and scope of the invention.

What is claimed is:

1. A photographic element comprising:

a support;

one or more imaged layers, derived from a silver halide emulsion comprising a colored dye formed from the reaction product of an oxidized developer and a dye forming coupler, and a protective overcoat, overlying said imaged layers, comprising a water-dispersible, hydrophobic polyester resin having the following general formula:

$$I_n—P—A_m$$

wherein I is an ionic group;

n is an integer from 1–3;

P is a polyester backbone;

A is an Asiatic group comprising a straight or branched chain fatty acid or triglyceride thereof having from about 6 to about 24 carbon atoms; and m is an integer from 3–8.

2. The element of claim 1 wherein said support is paper.

3. The element of claim 1 wherein said support is poly (ethylene terephthalate).

4. The element of claim 1 wherein said overcoat layer contains a blend of said water-dispersible, hydrophobic polyester resin with a thermoplastic or thermosetting polymer.

5. The element of claim 4 wherein said water-dispersible, hydrophobic polyester resin and said thermoplastic or thermosetting polymer is present in ratio of from about 1:6 to about 6:1.

6. The element of claim 5 wherein said thermoplastic or thermosetting polymer comprises a polyurethane polymer or copolymer.

7. The element of claim 1 wherein said water-dispersible, hydrophobic polyester resin comprises water-dispersed transesterified polyester.

8. The element of claim 1 wherein said overcoat layer also contains a synthetic or natural wax and/or a microgel.

9. The element of claim 5 wherein said overcoat layer also contains a synthetic or natural wax and/or a microgel.

10. The photographic element of claim 1 wherein the overcoat further comprises one or more addenda selected from the group consisting of UV absorbers, surfactants, emulsifiers, coating aids, lubricants, matte particles, rheology modifiers, speed-control dyes, crosslinking agents for gelatin, antifoggants, inorganic fillers, pigments, magnetic particles and biocides.

11. The photographic element of claim 1 further comprising an antistatic layer superposed on the support.

12. The photographic element of claim 1 further comprising a transparent magnetic layer superposed on the support.

13. A method of making a photographic element having a developed image comprising:

(a) providing a photographic element comprising a support, at least one silver halide emulsion layer superposed on a side of said support;

(b) imagewise exposing the photographic element to light;

(c) developing the photographic element in a photoprocessing solution;

(d) coating the developed photographic element with an overcoat comprising a water-dispersible, hydrophobic polyester resin having the following general formula:

$$I_n—P—A_m$$

wherein I is an ionic group; n is an integer from 1–3; P is a polyester backbone; A is an Asiatic group comprising a straight or branched chain fatty acid or triglyceride thereof having from about 6 to about 24 carbon atoms; and m is an integer from 3–8.

14. The method of claim 13 further comprising fusing the overcoat by the application of heat at a temperature of 70 to 160° C.

15. A photographic element comprising:

a support;

one or more imaged layers, derived from a silver halide emulsion comprising a colored dye formed from the reaction product of an oxidized developer and a dye forming coupler, and a protective overcoat, overlying said silver halide emulsion layer, comprising;

(i) a water-dispersible, hydrophobic polyester resin having a Tg less than 70° C. and having the following general formula:

$$I_n—P—A_m$$

wherein I is an ionic group;

n is an integer from 1–3;

P is a polyester backbone;

A is an Asiatic group comprising a straight or branched chain fatty acid or triglyceride thereof having from about 6 to about 24 carbon atoms; and m is an integer from 3–8; and (ii) a thermoplastic or thermosetting polymer blended with a thermoplastic or thermosetting polymer selected from polyurethanes, acrylate or methacrylate esters, and copolymers thereof, wherein said water-dispersible, hydrophobic polyester resin and said thermoplastic or thermosetting polymer is present in ratio of from about 1:6 to about 6:1, wherein the Tg of the overcoat composition is at least 70° C.

16. A photographic element comprising:

a support;

one or more imaged layers, derived from a silver halide emulsion comprising a colored dye formed from the reaction product of an oxidized developer and a dye forming coupler, and a protective overcoat, overlying said silver halide emulsion layer, comprising;

(i) a water-dispersible, hydrophobic polyester resin having a Tg less than 70° C. and having the following general formula:

$$I_n—P—A_m$$

wherein I is an ionic group;

n is an integer from 1–3;

P is a polyester backbone;

A is an Asiatic group comprising a straight or branched chain fatty acid or triglyceride thereof having from about 6 to about 24 carbon atoms; and m is an integer from 3–8; and (ii) an effective amount of microgel particles for increasing the glass transition temperature of the overcoat, said particles comprising a polymerizable carboxylic acid monomer, a difunctional crosslinking monomer, and a water-insoluble, ethylenically unsaturated or vinyl-type monomer, wherein the Tg of the overcoat composition is at least 70° C.

17. The photographic element of claim 16, further comprising an effective amount of a synthetic or of a synthetic or natural wax to lower the kinetic coefficient of friction.

* * * * *

UNITED STATES PATENT AND TRADEMARK OFFICE

CERTIFICATE OF CORRECTION

PATENT NO. : 6,506,527 B1
DATED : January 14, 2003
INVENTOR(S) : Lawrence P. Demejo It is certified that error appears in the above-identified patent and that said Letters Patent is hereby corrected as shown below:

Title page,
Item [57], ABSTRACT, remove "Asiatic" and in place thereof insert -- aliphatic --.

Column 2,
Line 52, remove "Asiatic" and in place thereof insert -- aliphatic --.

Column 3,
Line 62, remove "Asiatic" and in place thereof insert -- aliphatic --.

Column 4,
Line 2, remove "Asiatic" and in place thereof insert -- aliphatic --.

Column 23,
Line 24, remove "Asiatic" and in place thereof insert -- aliphatic --.

Column 24,
Lines 1 and 33, remove "Asiatic" and in place thereof insert -- aliphatic --.

Signed and Sealed this

Ninth Day of September, 2003

JAMES E. ROGAN
*Director of the United States Patent and Trademark Office*